US009743817B2

(12) United States Patent
Kimmerle et al.

(10) Patent No.: US 9,743,817 B2
(45) Date of Patent: Aug. 29, 2017

(54) BRUSH ROLLER MAGNET ASSEMBLY

(71) Applicants: William R. Kimmerle, Hudson, OH (US); William L. Kimmerle, Hudson, OH (US)

(72) Inventors: William R. Kimmerle, Hudson, OH (US); William L. Kimmerle, Hudson, OH (US)

( * ) Notice: Subject to any disclaimer, the term of this patent is extended or adjusted under 35 U.S.C. 154(b) by 0 days.

(21) Appl. No.: 14/609,114

(22) Filed: Jan. 29, 2015

(65) Prior Publication Data

US 2015/0208889 A1 Jul. 30, 2015

Related U.S. Application Data

(60) Provisional application No. 61/933,511, filed on Jan. 30, 2014.

(51) Int. Cl.

| | |
|---|---|
| ***A47L 9/04*** | (2006.01) |
| ***A46B 13/00*** | (2006.01) |
| ***A46B 15/00*** | (2006.01) |

(52) U.S. Cl.

CPC ..... *A47L 9/0477* (2013.01); *A46B 13/001* (2013.01); *A46B 15/0026* (2013.01)

(58) Field of Classification Search

CPC .. A47L 9/0477; A46B 13/001; A46B 15/0026
See application file for complete search history.

(56) References Cited

U.S. PATENT DOCUMENTS

| | | | |
|---|---|---|---|
| 3,253,295 | A | 5/1966 | Waters |
| 4,163,999 | A | 8/1979 | Eaton et al. |
| 4,245,370 | A | 1/1981 | Baker |
| 4,328,522 | A | 5/1982 | Tryan |
| 4,370,690 | A | 1/1983 | Baker |
| 4,398,231 | A | 8/1983 | Currence |
| 4,403,372 | A | 9/1983 | Keane et al. |
| 4,637,092 | A | 1/1987 | Hayashi et al. |
| 4,654,924 | A | 4/1987 | Getz et al. |
| 4,654,927 | A | 4/1987 | Novinger |
| 4,692,754 | A | 9/1987 | Edejer et al. |
| 4,706,327 | A | 11/1987 | Getz et al. |
| 4,728,942 | A | 3/1988 | England |
| 4,731,898 | A | 3/1988 | Sovis et al. |
| 4,847,944 | A | 7/1989 | Lackner |
| 4,955,103 | A | 9/1990 | Scott et al. |
| 5,014,387 | A | 5/1991 | Hays |

(Continued)

*Primary Examiner* — Shay Karls
(74) *Attorney, Agent, or Firm* — Emerson Thomson Bennett, LLC

(57) ABSTRACT

Provided is a brush roller magnet assembly which may be utilized on various types of mechanical devices such as a vacuum cleaner. The brush roller magnet assembly includes a brush roller having a first end, a second end, a cylindrical lateral outer surface and an opening positioned at any point along the cylindrical lateral surface of the brush roller. The opening of the brush roller opening has at least one side surface, a bottom surface, a width, a depth and a borehole positioned at the bottom surface of the opening. A magnet having an opening is positioned within the brush roller opening and a connector is received within the magnet opening to fasten the magnet to the brush roller. The position of the magnet inserted within the brush roller opening is adjustable through various means disclosed herein.

20 Claims, 4 Drawing Sheets

(56) References Cited

U.S. PATENT DOCUMENTS

| | | | | |
|---|---|---|---|---|
| 5,038,484 | A | 8/1991 | Rench et al. | |
| 5,056,175 | A | 10/1991 | Stein et al. | |
| 5,193,243 | A | 3/1993 | Stegens | |
| 5,373,598 | A | 12/1994 | Weber et al. | |
| 6,393,657 | B1 | 5/2002 | Zimet | |
| 8,602,220 | B1 * | 12/2013 | Porter | A46B 15/0026 209/215 |
| 2005/0044655 | A1 * | 3/2005 | Anderson | A47L 9/04 15/339 |

* cited by examiner

BRUSH ROLLER MAGNET ASSEMBLY

I. BACKGROUND

A. Field of the Invention

This invention generally relates to apparatuses and methods related to vacuum cleaners and more specifically to apparatuses and methods related to the installation and adjustment of magnets attached to a vacuum cleaner brush roll (also referred to herein as a brush roller).

B. Description of Related Art

It is well known to provide vacuum cleaners with brush rolls. Brush rolls are typically cylindrically shaped components that have brushes on their outer surfaces. Brush rolls are rotatable about their axial centerline to scrape or rub the brushes against a floor surface to assist in cleaning the floor surface. It is also known to attach permanent magnets to brush rolls. While such magnets may be used for many reasons, typically they are used to determine if the brush roll is rotating and/or to determine the speed at which the brush roll is rotating. For example, such magnets may be utilized in conjunction with a coil to generate an alternating current which is used to activate an indicator light on a brush roll housing of a vacuum cleaner. This indicator light provides a signal to the user that the brush roll is properly rotating.

There are two primary known methods for attaching such magnets to brush rolls. The first is to embed the magnets into the outer surface of the brush roll. This method typically includes the use of press-fit magnets or the use of an adhesive to secure the magnet to the brush roll. While embedded magnets generally work well for their intended purposes, they have drawbacks. One drawback is that once embedded they are very difficult to remove or position adjust. Such magnets are also very difficult to replace, if necessary.

The second known method for attaching permanent magnets to brush rolls is through the use of a magnet holder. Magnet holders are typically ring shaped and mount to the brush roll. Examples of ring shaped magnet holders are provided in U.S. Pat. No. 4,728,942 to England titled Self-Powered Rotation Indicator and U.S. Pat. No. 6,393,657 to Zimet titled Brush Roll Rotation Indicator. While magnet holders generally work well for their intended purposes, they have drawbacks also. One drawback is the added complexity and cost that comes with magnet holders. Another drawback is that they are also difficult to remove or position adjust.

What is needed is a brush roll magnet that is easy to remove and adjust and that is also inexpensive and non-complex in its assembly within the brush roll.

II. SUMMARY

Provided is a vacuum cleaner brush roller magnet assembly. The vacuum cleaner brush roller magnet assembly includes a brush roller having a first end, a second end, a cylindrical lateral outer surface and an opening within the cylindrical lateral surface of the brush roller. The brush roller opening has a width, a depth, at least one side surface, a bottom surface and a borehole at the bottom surface of the opening. The brush roller magnet assembly also includes a magnet positioned within the opening. The magnet has an outer surface, a width, a length and an opening which extends along the length of the magnet. The brush roller magnet assembly also includes a connector received within the magnet opening. The connector has a length that is greater than the length of the magnet and has an end portion which extends within the borehole. The length of the magnet is less than the depth of the brush roller opening and the magnet is adjustable to a plurality of varying depths within the brush roller opening.

According to further aspects of the present disclosure, the magnet has a width which is less than the width of the brush roller opening.

According to further aspects of the present disclosure, the magnet is adjustable to a plurality of varying depths within the brush roller opening by adjusting the length of the portion of the connector which extends within the borehole.

According to further aspects of the present disclosure, the magnet inserted within the brush roller opening is removable from the brush roller opening through disengagement of the connector from the brush roller.

According to further aspects of the present disclosure, magnets of varying strength may be inserted within the brush roller opening.

According to further aspects of the present disclosure, magnets of varying strength positioned within the brush roller opening are adjustable within the brush roller opening by adjusting the length of the portion of the connector which extends into the borehole.

According to further aspects of the present disclosure, the magnet opening is substantially collinear with an axial centerline of the magnet.

According to further aspects of the present disclosure, an axial centerline of the magnet opening is substantially collinear with an axial centerline of the brush roller opening.

According to further aspects of the present disclosure, the axial centerline of the magnet opening and the axial centerline of the brush roller opening are substantially collinear with an axial centerline of the borehole.

According to further aspects of the present disclosure, the magnet and the brush roller opening may have a circular cross-section.

According to further aspects of the present disclosure, the connector has a head and a body.

According to further aspects of the present disclosure, the body of the connector has threads on its outer surface and the head of the connector has a tool reception surface that receives a tool which is used to attach and secure the connector to the brush roller and which is also used to detach the connector from the brush roller.

According to further aspects of the present disclosure, the magnet opening is threaded to engage the threads on the connector and the magnet is adjustable to a plurality of varying depths within the brush roller opening by adjusting the position of the magnet with respect to the connector.

According to further aspects of the present disclosure, a portion of the connector is press-fit to the magnet through the magnet opening, the brush roller opening includes a side surface which is threaded, the outer surface of the magnet is threaded to engage the threaded side surface of the brush roller opening and the magnet is adjustable to a plurality of varying depths within the brush roller opening by adjusting the connector through the tool reception surface of the connector head to adjust the magnet's position within the brush roller opening.

According to further aspects of the present disclosure, the magnet is replaceable.

According to further aspects of the present disclosure, the connector provides sufficient securement of the magnet to the brush roller under conditions where the magnet would otherwise fall out of the roller brush opening.

According to further aspects of the present disclosure, the connector provides sufficient securement of the magnet to the brush roller under conditions where a brush roller's moisture content changes.

According to further aspects of the present disclosure, the connector provides sufficient securement of the magnet to the brush roller under conditions where a wood brush roller's moisture content changes.

According to further aspects of the present disclosure, the head of the connector may be larger than the brush roller opening.

According to further aspects of the present disclosure, the head of the connector may extend outward from the brush roller opening.

According to further aspects of the present disclosure, the head of the connector may be positioned above, below or flush with the cylindrical lateral outer surface of the brush roller.

According to further aspects of the present disclosure, the connector height may be less than the depth of the brush roller opening.

According to further aspects of the present disclosure, the brush roller magnet assembly may be positioned at any point along the cylindrical lateral outer surface of the brush roller.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
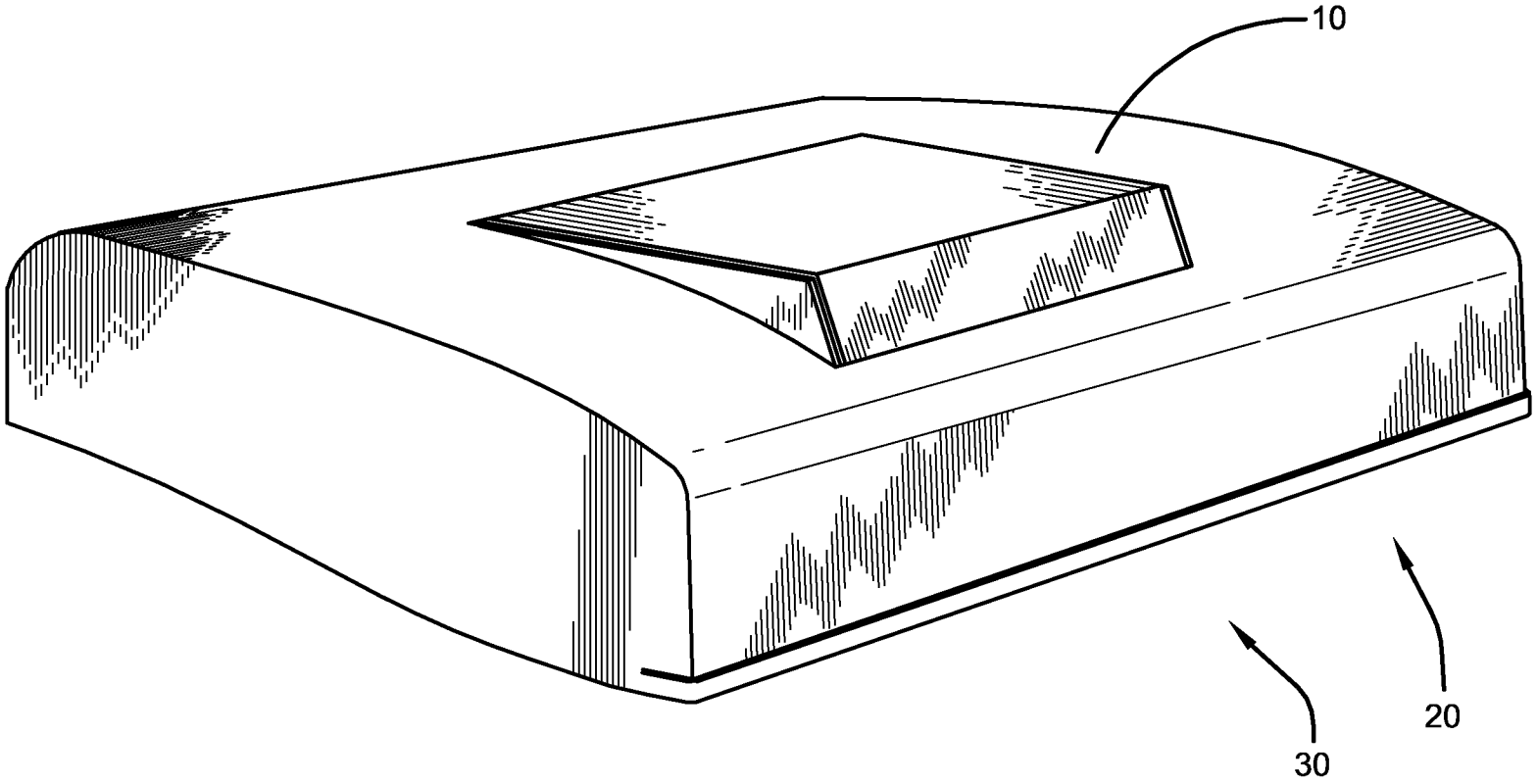
FIG. 1 is a perspective top view of a vacuum housing.

Referring now to the drawings wherein the showings are for purposes of illustrating embodiments of the invention only and not for purposes of limiting the same, and wherein like reference numerals are understood to refer to like components, FIG. 1 shows a vacuum cleaner housing 10 that may make up a portion of a vacuum cleaner and that may use a brush roller 20 and magnet assembly 30 according to some embodiments of this invention. As the operation of a vacuum cleaner is well known to those of skill in the art, further details will not be provided here.

Figure 2:
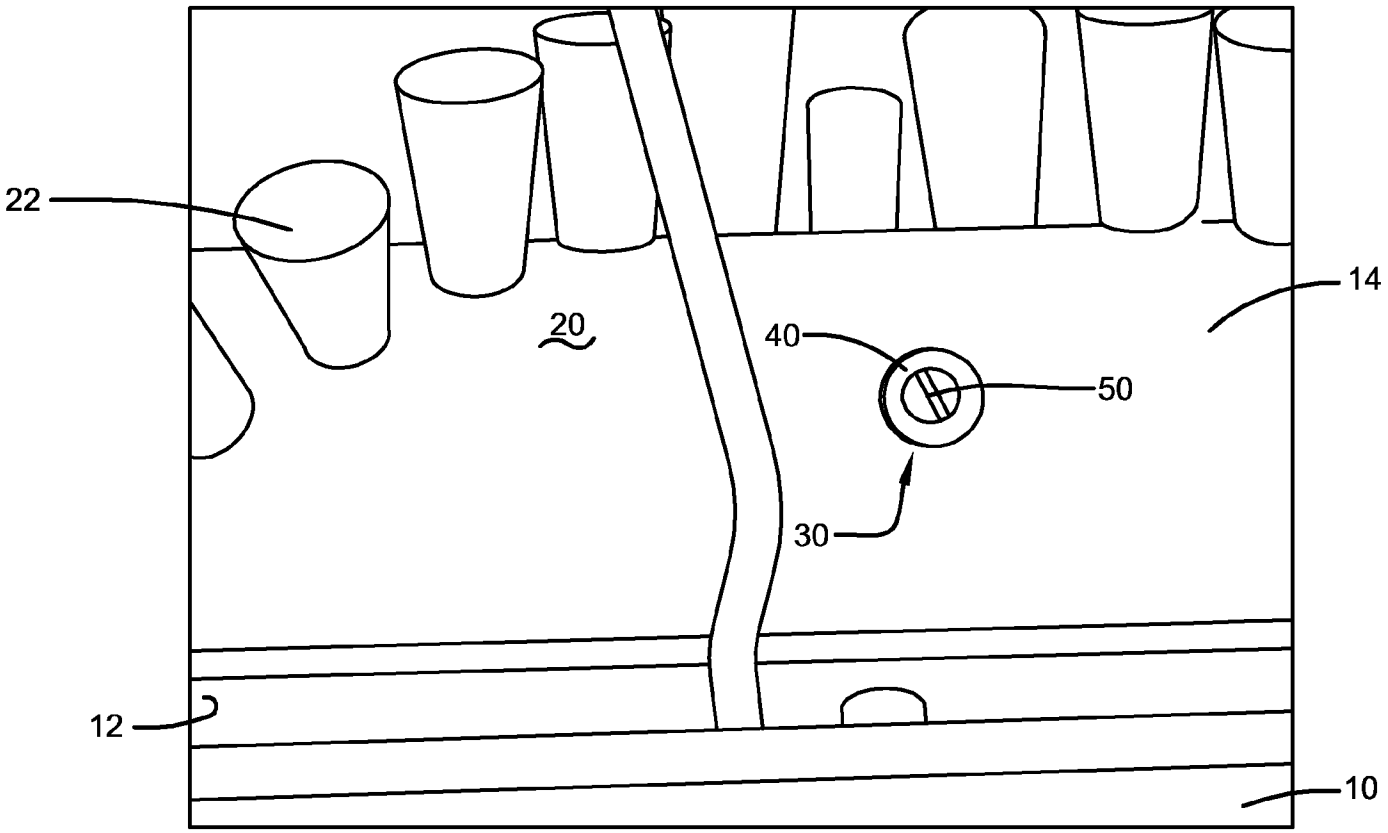
FIG. 2 is a bottom view of a vacuum housing showing the brush roll.
Figure 3:
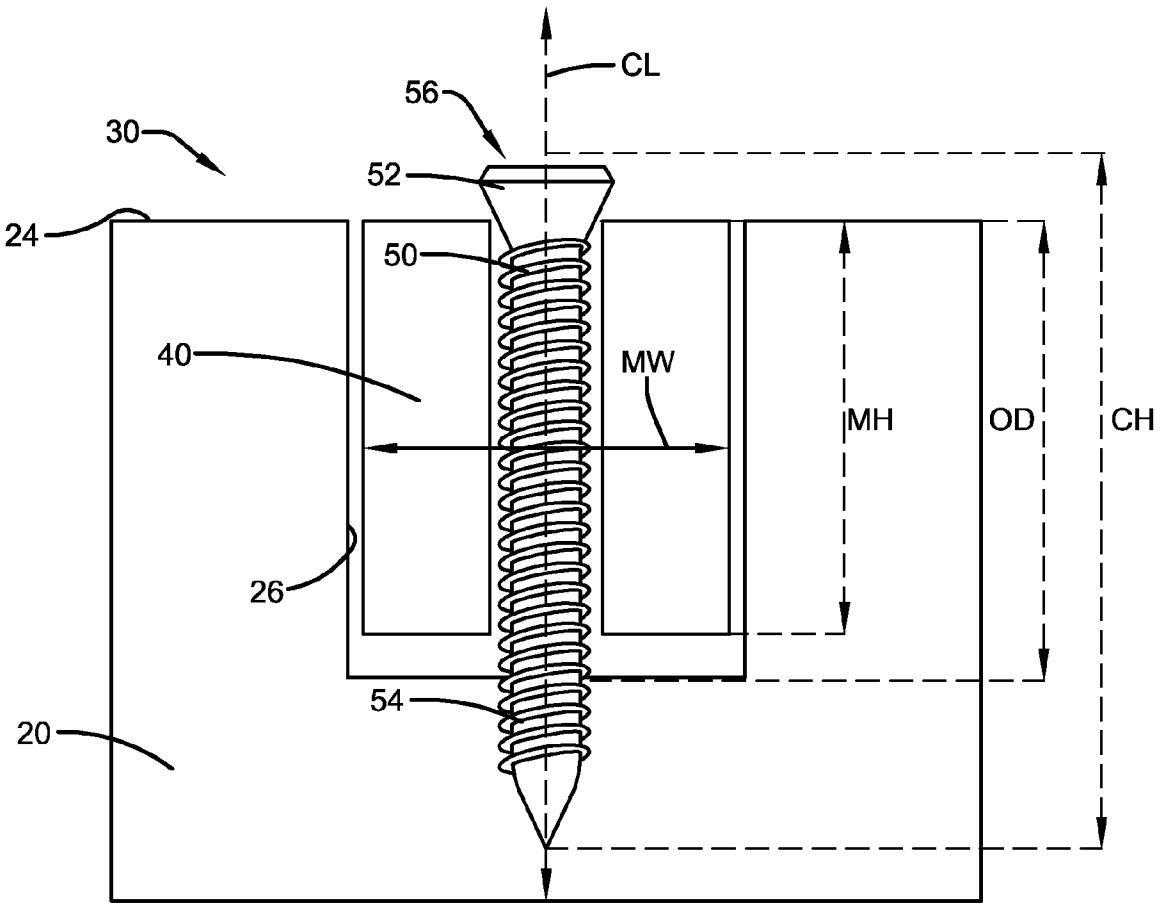
FIG. 3 is a sectional side-view showing a magnet attached to a brush roll.

FIG. 2 shows that the housing 10 may have an opening 12 through which debris may be drawn into the vacuum cleaner. The housing 10 may include one or more ribs 14 that extend across the opening 12. The ribs 14 may contact the floor surface when the vacuum cleaner is used. The brush roller 20 may be seen through the opening 12. Brush bristles 22 may extend out from the brush roller's outer surface 24 (referenced in FIG. 3) and may be used to brush or scrape a floor surface in a known manner. As shown in FIG. 3, the brush roller 20 may have an opening 26 that receives the magnet assembly 30.

With reference now to FIGS. 2 and 3, the magnet assembly 30 may include a magnet 40 and a connector 50 that attaches the magnet 40 to the brush roller 20. The magnet 40 may have a magnet width MW that is less than the width of the opening 26. In one embodiment, shown, there is a clearance (space) between the outer surface of the magnet 40 and the surface of the brush roller 20 that defines the opening 26. As a result, the magnet 40 can be easily inserted into and removed from the opening 26 in the brush roller 20. The magnet 40 may have a height or length MH or ML and the opening 26 may have a depth OD. In one embodiment, the magnet height/length MH/ML is the same as depth OD. In another embodiment, height/length MH/ML is greater than depth OD. In this case, the top portion of the magnet 40 would extend above the brush roller's outer surface 24. In yet another embodiment, shown, height/length MH/ML is less than depth OD. In any case, the position of the magnet 40 can be adjusted within the opening 26 to achieve optimal performance of the magnet 40. In certain embodiments, the position adjustment may be described as an adjustment of the position of the magnet within the opening or the depth of the magnet positioned within the opening 26. This adjustment permits a relatively weaker magnet to be used as an alternative to known vacuum cleaner magnets, reducing the cost.

Figure 4:
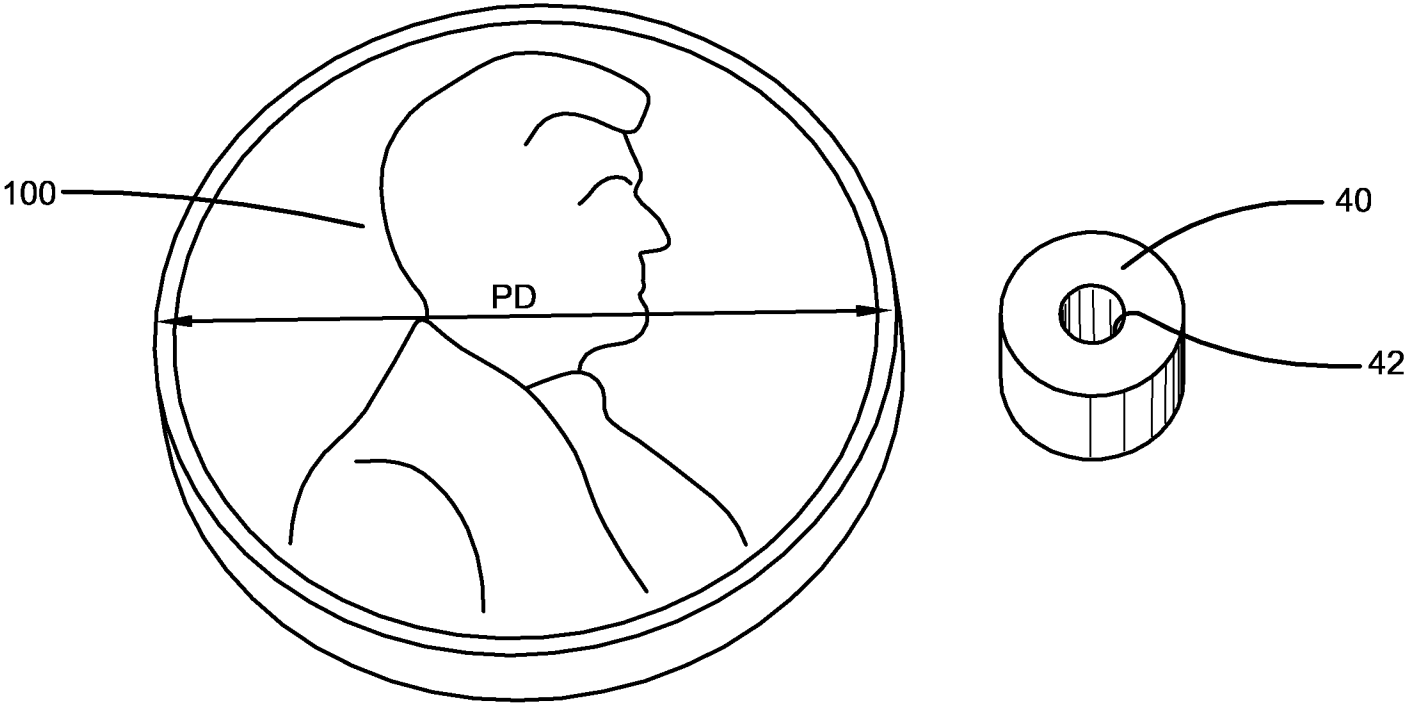
FIG. 4 is a top view of a magnet next to a penny.

With reference now to FIGS. 2, 3 and 4, the magnet 40 may have an opening 42 that receives a connector 50. In one embodiment, shown, the opening 42 may extend along the length/height of the magnet 40. In a specific embodiment, shown, the opening 42 may be substantially collinear with the axial centerline CL of the magnet 40. In another embodiment, also shown, the axial centerline CL of the opening 42 may be substantially collinear with the axial centerline of opening 26. The clearance between the magnet 40 and the surface of the brush roller 20 that defines opening 26 may be substantially the same around the perimeter of the magnet 40. For the embodiment shown, both the magnet 40 and the opening 26 may have a circular cross-section. In this case magnet width MW is an outside diameter. The magnet 40 may be relatively small. FIG. 4 shows the magnet 40 next to a normal sized American penny 100. Note that for this embodiment the penny's diameter PD is approximately four times (×4) the magnet's width MW.

With reference now to FIGS. 2 and 3, the connector 50 can be of any type and size that adequately secures the magnet 40 to the brush roller 20. The connector 50 may have a head 52 and a body 54. For the embodiment shown, the connector 50 is a screw so the body 54 has threads on its outer surface and the head has a tool reception surface 56 that receives a tool (not shown but in one embodiment a screw driver). Such a tool can be used to easily and quickly attach or secure the connector 50 (and the magnet 40) to the brush roller 20 and to easily and quickly detach the connector 50 (and the magnet 40) from the brush roller 20. In certain embodiments, the brush roller opening (26) has a bottom surface which includes a borehole. The borehole may provide a cavity through which the bottom portion of the body of the connector 50 may be inserted and adjusted accordingly. Thus, the end of connector 50 can be adjusted to various lengths within the borehole. Through various adjustments of end of the connector 50 within the borehole, the height of the magnet 40 within the opening 26 can be adjusted. This feature also allows for the variously sized magnets 40 to be inserted within the opening 26 as both smaller and larger sized magnets may be inserted within the opening and adjusted to the proper height within the opening 26 which allows for determining brush roll rotation and/or speed. In certain embodiments, the borehole is threaded to engage a threaded connector 50. The use of a connector also provides sufficient magnet securement even when the magnet would otherwise "fall out"—such as if/when the moisture content of the brush roll material (typically wood)

changes. The head 52 of the connector 50 may be larger than the opening 42, as shown, to prevent the magnet 40 from detaching while the connector 50 is attached to the brush roller 20. In other embodiments, the head 52 of the connector may be smaller than the opening 42. The connector 50 may have a height/length CH/CL that, for the embodiment shown, is greater than the magnet height/length MH/ML. For the embodiment shown, the top or head of the connector extends out of the opening 26. In another embodiment, the top or head of the connector is positioned below the brush roller's outer surface 24. This allows for another embodiment where the connector height/length CH/CL may be less than the depth of the opening 26.

In an alternative embodiment, the magnet opening 42 may be threaded to engage the threads on the connector 50. In such embodiments, the magnet is adjustable to a plurality of varying depths within the opening 26 by adjusting the position of the magnet with respect to the connector 50.

In a further alternative embodiment, the connector 50 may be press-fit into the magnet 40 through the magnet opening 42. In such embodiments, the opening 26 may be threaded and the magnet 40 may have an outer surface which is also threaded. The threads on the outer surface of the magnet 40 may therefore, engage on the threads within the opening 26. Through this configuration, a tool may be used to engage the tool reception surface on the connector head to adjust the magnet 40 to various depths within the opening 26 by rotating the magnet within opening 26.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

Having thus described the invention, it is now claimed:

1. A vacuum cleaner brush roller magnet assembly comprising:

a brush roller having a first end, a second end, a cylindrical lateral outer surface and an opening within the cylindrical lateral surface of the brush roller, wherein the opening has a width, a depth, at least one side surface, a bottom surface and a borehole at the bottom surface of the opening;

a magnet positioned within the opening, wherein the magnet has an outer surface, a width, a length and an opening which extends along the length of the magnet;

a connector received within the magnet opening, wherein the connector has a length that is greater than the length of the magnet and has an end portion which extends within the borehole;

wherein the length of the magnet is less than the depth of the brush roller opening and wherein the magnet is adjustable to a plurality of varying depths within the brush roller opening.

2. The vacuum cleaner brush roller magnet assembly of claim 1, wherein the magnet is adjustable to a plurality of varying depths within the brush roller opening by adjusting the length of the portion of the connector which extends within the borehole.

3. The vacuum cleaner brush roller magnet assembly of claim 1, wherein the magnet inserted within the brush roller opening is removable from the brush roller opening through disengagement of the connector from the brush roller.

4. The vacuum cleaner brush roller magnet assembly of claim 1, wherein magnets of varying strength may be inserted within the brush roller opening.

5. The vacuum cleaner brush roller magnet assembly of claim 4, wherein magnets of varying strength positioned within the brush roller opening are adjustable within the brush roller opening by adjusting the length of the portion of the connector which extends into the borehole.

6. The vacuum cleaner brush roller magnet assembly of claim 1, wherein the magnet opening is substantially collinear with an axial centerline of the magnet.

7. The vacuum cleaner brush roller magnet assembly of claim 6, wherein an axial centerline of the magnet opening is substantially collinear with an axial centerline of the brush roller opening.

8. The vacuum cleaner brush roller magnet assembly of claim 7, wherein the axial centerline of the magnet opening and the axial centerline of the brush roller opening are substantially collinear with an axial centerline of the borehole.

9. The vacuum cleaner brush roller magnet assembly of claim 1, wherein the magnet and the brush roller opening have a circular cross-section.

10. The vacuum cleaner brush roller magnet assembly of claim 1, wherein the connector comprises a head and a body.

11. The vacuum cleaner brush roller magnet assembly of claim 10, wherein the body of the connector has threads on its outer surface and wherein the head of the connector has a tool reception surface that receives a tool which is used to attach and secure the connector to the brush roller and which is also used to detach the connector from the brush roller.

12. The vacuum cleaner brush roller magnet assembly of claim 11, wherein the magnet opening is threaded to engage the threads on the connector and wherein the magnet is adjustable to a plurality of varying depths within the brush roller opening by adjusting the position of the magnet with respect to the connector.

13. The vacuum cleaner brush roller magnet assembly of claim 10, wherein the head of the connector is positioned above, below or flush with the cylindrical lateral outer surface of the brush roller.

14. The vacuum cleaner brush roller magnet assembly of claim 1, wherein the magnet and the connector are replaceable.

15. The vacuum cleaner brush roller magnet assembly of claim 1, wherein the connector provides sufficient securement of the magnet to the brush roller under conditions where the magnet would otherwise fall out of the roller brush opening.

16. The vacuum cleaner brush roller magnet assembly of claim 15, wherein the connector provides sufficient securement of the magnet to the brush roller under conditions where a brush roller's moisture content changes.

17. The vacuum cleaner brush roller magnet assembly of claim 16, wherein the connector provides sufficient securement of the magnet to the brush roller under conditions where a wood brush roller's moisture content changes.

18. The vacuum cleaner brush roller magnet assembly of claim 1, wherein the vacuum cleaner brush roller magnet assembly is positioned at any point along the cylindrical lateral outer surface of the brush roller.

19. A vacuum cleaner brush roller magnet assembly comprising:

a brush roller having a first end, a second end, a cylindrical lateral outer surface and an opening within the cylindrical lateral surface of the brush roller, wherein the opening has a width, a depth, at least one side surface, a bottom surface and a borehole at the bottom surface of the opening;

a magnet positioned within the opening, wherein the magnet has an outer surface, a width, a length and an opening which extends along the length of the magnet;

a connector received within the magnet opening, wherein the connector has a length that is greater than the length of the magnet and has an end portion which extends within the borehole;

wherein the length of the magnet is less than the depth of the brush roller opening and wherein the magnet is adjustable to a plurality of varying depths within the brush roller opening;

wherein the connector comprises a head and a body;

wherein the body of the connector has threads on its outer surface and wherein the head of the connector has a tool reception surface that receives a tool which is used to attach and secure the connector to the brush roller and which is also used to detach the connector from the brush roller;

wherein a portion of the body of the connector is press-fit to the magnet through the magnet opening, wherein the brush roller opening comprises a side surface which is threaded, wherein the outer surface of the magnet is threaded to engage the threaded side surface of the brush roller opening and wherein the magnet is adjustable to a plurality of varying depths within the brush roller opening by adjusting the connector through the tool reception surface of the connector head to adjust the magnet's position within the brush roller opening.

20. A vacuum cleaner brush roller magnet assembly comprising:

a brush roller having a first end, a second end, a cylindrical lateral outer surface and an opening within the cylindrical lateral surface of the brush roller, wherein the opening has a width, a depth, at least one side surface, a bottom surface and a borehole at the bottom surface of the opening;

a magnet positioned within the opening, wherein the magnet has an outer surface, a width, a length and an opening which extends along the length of the magnet;

a connector received within the magnet opening, wherein the connector has a length that is greater than the length of the magnet and which has an end portion which extends within the borehole;

wherein the length of the magnet is less than the depth of the brush roller opening and wherein the magnet is adjustable to a plurality of varying depths within the brush roller opening by adjusting the length of the portion of the connector which extends within the borehole;

wherein the magnet inserted within the brush roller opening is removable from the brush roller opening through disengagement of the connector from the brush roller, wherein magnets of varying strength may be inserted within the brush roller opening, wherein magnets of varying strength may be adjusted within the brush roller opening by adjusting the length of the portion of the connector with extends into the borehole, wherein the magnet opening is substantially collinear with an axial centerline of the magnet, wherein an axial centerline of the magnet opening is substantially collinear with an axial centerline of the brush roller opening, wherein the axial centerline of the magnet opening and the axial centerline of the brush roller opening are substantially collinear with an axial centerline of the borehole, wherein the magnet and the brush roller opening have a circular cross-section, wherein the connector comprises a head and a body, wherein the body of the connector has threads on its outer surface and wherein the head of the connector has a tool reception surface that receives a tool which is used to attach and secure the connector to the brush roller and which is also used to detach the connector from the brush roller, wherein the magnet and the connector are replaceable, wherein the connector provides sufficient securement of the magnet to the brush roller under conditions where a wood brush roller's moisture content changes, wherein the head of the connector is positioned above, below or flush with the cylindrical lateral outer surface of the brush roller and wherein the vacuum cleaner brush roller magnet assembly is positioned at any point along the cylindrical lateral outer surface of the brush roller.

* * * * *